US010975536B2

(12) United States Patent
Schreil

(10) Patent No.: US 10,975,536 B2
(45) Date of Patent: Apr. 13, 2021

(54) ROAD MILLING MACHINE

(71) Applicant: Wirtgen GmbH, Windhagen (DE)

(72) Inventor: Sascha Schreil, Windeck (DE)

(73) Assignee: Wirtgen GmbH

( * ) Notice: Subject to any disclaimer, the term of this patent is extended or adjusted under 35 U.S.C. 154(b) by 5 days.

(21) Appl. No.: 16/508,636

(22) Filed: Jul. 11, 2019

(65) Prior Publication Data

US 2020/0024811 A1 Jan. 23, 2020

(30) Foreign Application Priority Data

Jul. 17, 2018 (DE) ..... 10 2018 211 880.9

(51) Int. Cl.
*E01C 23/00* (2006.01)
*E01C 23/088* (2006.01)

(52) U.S. Cl.
CPC ..... *E01C 23/088* (2013.01); *E01C 2301/50* (2013.01)

(58) Field of Classification Search
USPC ..... 404/72, 75, 83–97, 118
See application file for complete search history.

(56) References Cited

U.S. PATENT DOCUMENTS 4,012,160 A * 3/1977 Parker ..... E01C 19/4873 404/84.05
4,974,907 A * 12/1990 Komura ..... B23D 59/006 299/39.3
5,069,693 A * 12/1991 Blikken ..... E03F 5/08 96/347

(Continued)

FOREIGN PATENT DOCUMENTS

CN 106012932 A 10/2016
CN 205717433 U 11/2016

(Continued)

OTHER PUBLICATIONS

European Patent Office Search Report for corresponding EP 19 17 0634, dated Nov. 13, 2019, 3 pages. (not prior art).

(Continued)

*Primary Examiner* — Raymond W Addie

(74) *Attorney, Agent, or Firm* — Lucian Wayne Beavers; Patterson Intellectual Property Law, PC

(57) ABSTRACT

In a road milling machine (1), comprising a machine frame (6), at least three travelling devices (2, 3), wherein at least two travelling devices (3) are drivable and at least one travelling device (2) is steerable, at least one milling drum (11) for working the ground pavement (4), at least one extraction device (12) for extracting air contaminated with dusts and vapours, it is provided for the following features to be achieved: the extraction device (12) comprises at least one first exhaust air pipe (13) with at least one first pipe section (24) with at least one first cross-section (26) and at least one second pipe section (20) with at least one second cross-section (22), wherein the second cross-section (22) is smaller than the first cross-section (26), wherein a suction channel (18) comprises an inlet opening (30) and an outlet opening, wherein the outlet opening (28) opens into the exhaust air pipe (13) in the area of the second pipe section (20), wherein the air contaminated with dusts and vapours can be sucked in at the inlet opening (30).

15 Claims, 4 Drawing Sheets

(56) References Cited

U.S. PATENT DOCUMENTS

| | | | | |
|---|---|---|---|---|
| 5,092,658 | A | 3/1992 | Smith | |
| 5,443,325 | A * | 8/1995 | Simonelli | E01C 19/48 404/75 |
| 5,938,371 | A * | 8/1999 | Gustin | E01C 19/48 404/101 |
| 6,733,086 | B1 | 5/2004 | McSharry et al. | |
| 7,175,364 | B2 * | 2/2007 | Gaertner | E01C 23/088 299/39.2 |
| 9,121,147 | B2 * | 9/2015 | Karsten | E01C 23/088 |
| 9,273,433 | B2 * | 3/2016 | Musil | E01C 23/088 |
| 2005/0117970 | A1 * | 6/2005 | Gaertner | F01P 11/10 404/93 |
| 2006/0198697 | A1 * | 9/2006 | Hall | E01C 23/0885 404/75 |
| 2015/0104255 | A1 * | 4/2015 | Musil | E01C 23/088 404/76 |
| 2017/0009410 | A1 * | 1/2017 | Sansone | E01C 23/088 |
| 2017/0350080 | A1 * | 12/2017 | Hirman | E01C 23/127 |
| 2018/0127930 | A1 * | 5/2018 | Lindholm | E01C 23/127 |
| 2019/0284038 | A1 * | 9/2019 | Landman | B67D 1/0462 |
| 2019/0382968 | A1 * | 12/2019 | Hirman | E01C 23/088 |
| 2020/0149231 | A1 * | 5/2020 | Lo Vaglio | B24C 9/006 |

FOREIGN PATENT DOCUMENTS

| | | | |
|---|---|---|---|
| CN | 108265659 | A | 7/2018 |
| DE | 2355232 | A1 | 5/1975 |
| DE | 10047443 | A1 | 4/2002 |
| WO | 03100172 | A1 | 12/2003 |

OTHER PUBLICATIONS

China Office Action on corresponding 2019106371864 dated Dec. 23, 2020, 3 pages (not prior art).

* cited by examiner

ROAD MILLING MACHINE

BACKGROUND

Field of the Disclosure

The invention relates to a road milling machine.

Description of the Prior Art

Known road milling machines comprise, as a rule, a machine frame and at least three travelling devices, wherein at least two travelling devices are driven and at least one travelling device is steerable. A road milling machine furthermore comprises at least one milling drum for working the ground pavement. An extraction device may also be provided for extracting air contaminated with dusts and vapours.

As a result of milling off the ground surface, dusts and vapours develop which deteriorate the working conditions for the machine operator on the operator's platform and the further operating personnel around the milling machine and, in some circumstances, also obstruct the visibility of the traffic that may be passing by.

An extraction device for a milling machine is known from WO 03/100172 which is connected to a first channel section attributed to the transport devices and, during milling, extracts contaminated air in the first channel section essentially in the direction of material transport.

The current state of the art often has the disadvantage that a fan of the extraction device is located in the dirty area, meaning that the air contaminated with dusts and vapours flows through the fan.

SUMMARY OF THE DISCLOSURE

It is the object of the invention to create a road milling machine in which the dusts and vapours developing during the milling operation can be extracted effectively without contaminating the fan of the extraction device.

The above-mentioned object is achieved by the features of the claims.

The invention advantageously provides that at least one first exhaust air pipe comprises at least one first pipe section with a first cross-section and at least one second pipe section with a second cross-section, wherein the second cross-section is smaller than the first cross-section, wherein a suction channel comprises an inlet opening and an outlet opening, wherein the outlet opening opens into the exhaust air pipe in the area of the second pipe section, wherein the air contaminated with dusts and vapours can be sucked in at the inlet opening.

The present invention offers the advantage that the Venturi effect is utilized in order to be able to particularly effectively extract the air contaminated with dusts and vapours.

In this arrangement, the first pipe section is located in front of the second pipe section as seen in the direction of flow. In the direction of flow means the direction in which the air flows through the extraction device, in particular, through the exhaust air pipe.

The extraction device may further comprise a fan which is connected to the first pipe section so that air can be blown into the extraction pipe by the fan.

The second pipe section is located behind the first pipe section as seen in the direction of flow. In the direction of flow also means in the direction in which the air is blown by the fan.

The present invention has the advantage that the fan is arranged in such a fashion that it is arranged on the clean side, that is, the air contaminated with vapours and dusts does not flow through the fan.

Fan is understood to mean a driven fluid flow machine which conveys air preferably by means of an impeller operated in a housing and, in the process, preferably achieves a pressure ratio between the suction side and the pressure side of between 1 and 1.3. It must be distinguished from fluid flow machines with a pressure ratio larger 1.3, which are compressors. A fan may also be called a blower or ventilator. The fan may be of the radial fan or the axial fan type.

The exhaust air pipe may be of single-piece or multiple-piece design. In the case of a multiple-piece exhaust air pipe, the individual parts may be connected to each other in a permanent or also in a detachable fashion.

The exhaust air pipe may, at least in the area of the first pipe section, extend along a first longitudinal axis, wherein the first longitudinal axis is arranged in such a fashion that it extends essentially perpendicular to the ground pavement, preferably exhibits an angle of between 70° and 90° to the ground pavement. The exhaust air pipe may, at least in the area of the second pipe section, extend along a second longitudinal axis, wherein the second longitudinal axis preferably extends parallel to the first longitudinal axis. As a result, the second longitudinal axis may also be arranged in such a fashion that it extends essentially perpendicular to the ground pavement, preferably exhibits an angle of between 70° and 90° to the ground pavement. If the first and the second pipe section are arranged concentrically to each other, the first and the second longitudinal axis form a common longitudinal axis.

Arranging the first and/or second longitudinal axis essentially perpendicular to the ground pavement has the advantage that coarse-particle dirt particles in the contaminated air, which are too heavy to be transported along by the air, fall to the ground due to gravity and, in this case, fall downwards in the direction of the ground pavement along the first and/or second longitudinal axis of the exhaust air pipe.

The fan may be arranged in such a fashion that, from the fan, the air enters the exhaust air pipe essentially perpendicular to the first and/or second longitudinal axis of the exhaust air pipe.

The suction channel may open into the exhaust air pipe essentially perpendicular relative to the first and/or second longitudinal axis of the exhaust air pipe.

The suction channel may project into the exhaust air pipe. This has the advantage that the flow velocity is particularly high at the outlet opening of the exhaust air channel and the air contaminated with dusts and vapours is carried away particularly effectively.

The exhaust air pipe may comprise a first opening and a second opening, wherein the second opening is arranged above the first opening, and the contaminated air may exit the second opening.

The first opening of the exhaust air pipe may be arranged on a side facing the ground pavement.

This has the advantage that coarse-particle dirt, which is not carried away by the air, can fall in the direction of the ground pavement.

A collection container may be arranged at the first opening of the exhaust air pipe. The collection container may collect the particularly coarse-particle dirt which falls in the direction of the ground pavement.

The fan may be arranged below the suction channel and, relative to the first and/or second longitudinal axis of the exhaust air pipe, laterally next to the exhaust air pipe.

The outlet opening of the suction channel may be located above the area in which the air blown by the fan is introduced into the exhaust air pipe.

The disclosed embodiment has the advantage that the fan is arranged in such a fashion that the coarse-particle dirt particles do not fall onto the fan but fall past the same.

An operator's platform may be provided, wherein the second opening of the exhaust air pipe is arranged above the operator's platform.

The exhaust air pipe may comprise a third pipe section which is arranged behind the second pipe section as seen in the direction of flow, wherein the third pipe section comprises a third cross-section which is larger than the second cross-section of the second pipe section.

A housing, in particular, a milling drum housing or milling drum casing, respectively, may be arranged around the milling drum, wherein on one side, in particular, on the rear side as seen in the direction of travel, an opening may be arranged into which the suction channel opens, and the opening may preferably form the inlet opening of the suction channel.

The contaminated air is thus extracted directly at the milling drum casing.

The road milling machine may be a small milling machine, wherein the small milling machine comprises at least two rear ground-engaging units and the milling drum is arranged between the rear ground-engaging units.

The extraction device may be demountable, and devices may be provided to which a transport conveyor may be fastened so that a transport conveyor is connectable in lieu of the extraction device.

The extraction device is therefore provided in particular in those cases where there is no transport conveyor provided on the road milling machine.

The exhaust air pipe may comprise a fourth pipe section which is arranged above the first and second pipe section, wherein the fourth pipe section is designed as a flexible hose which is stretchable in its length.

This has the advantage that the exhaust air pipe may be fastened to a height-adjustable roof of the road milling machine, wherein the roof may be a roof of the operator's platform.

BRIEF DESCRIPTION OF THE DRAWINGS

In the following, one embodiment of the present invention is explained in more detail with reference to the drawings.

The following is shown:

FIG. 1 shows a road milling machine 1 for working the ground pavement 4. The road milling machine 1 comprises a machine frame 6 and at least three travelling devices 2, 3. At least two travelling devices 3 are drivable and at least one travelling device 2 is steerable. The road milling machine may, however, also comprise four travelling devices, all of which may also be driven. In the embodiment depicted, the road milling machine is a small milling machine in which the milling drum 11 depicted merely by way of dashed lines is arranged between the rear travelling devices 3. The travelling devices 2, 3 may be wheels or tracked ground-engaging units. In the embodiment depicted, the travelling devices are wheels. The road milling machine comprises an operator's platform 8 and, above the operator's platform 8, a roof 62. The roof 62 may be height-adjustable in relation to the operator's platform.

Figure 1:
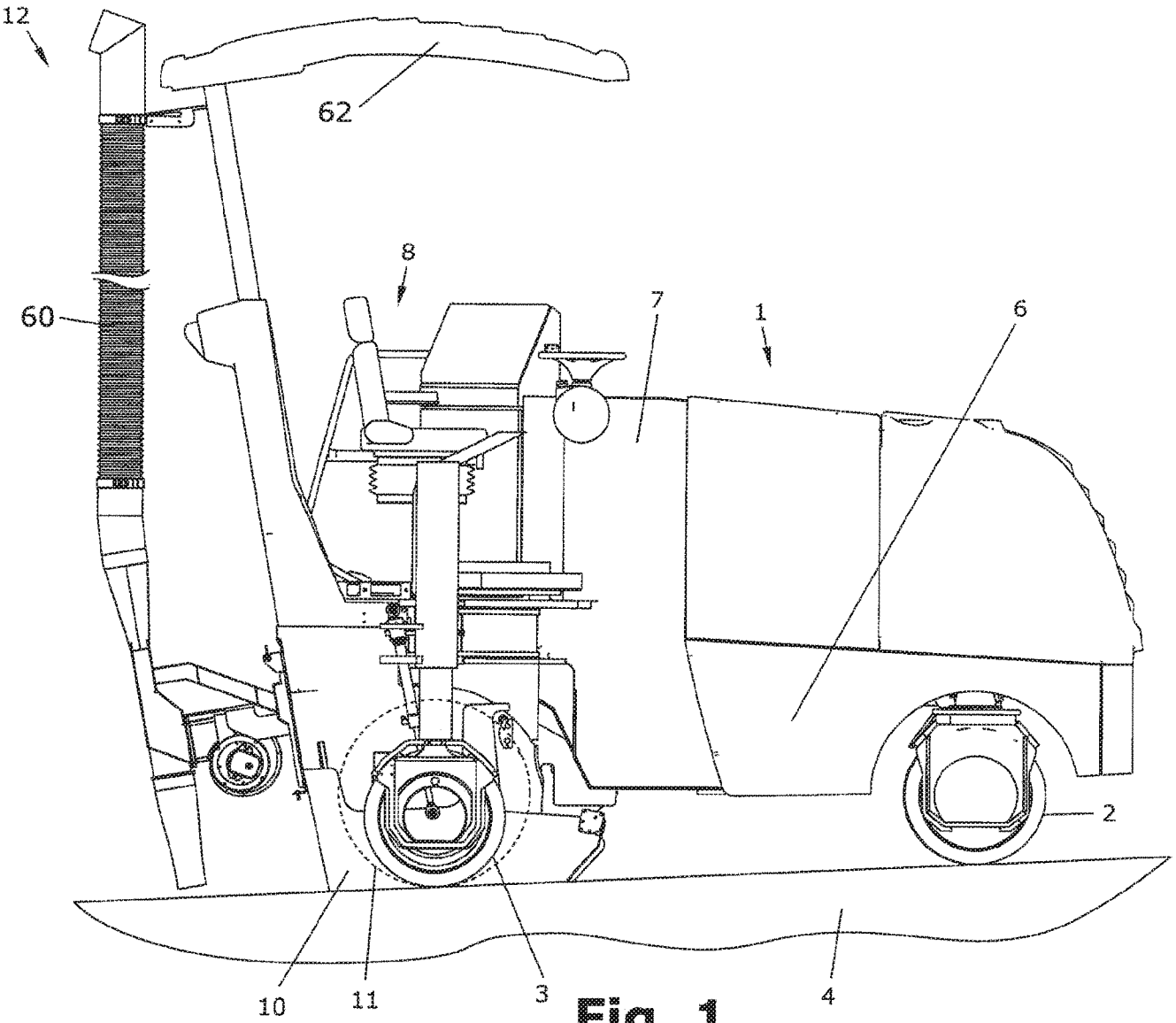
FIG. 1 A road milling machine according to the present disclosure.

The rear travelling devices 3 may be height-adjustable in relation to the machine frame 6. In the embodiment depicted, lifting columns are provided for the rear travelling devices by means of which the machine frame 6 is adjustable in height. In this way, the milling drum 11 supported on the machine frame 6 may also be adjusted in height. One of the two rear travelling devices 3 may be pivoted, from an outer limit position depicted in FIG. 1, inwards into a recess 7 of the machine frame 6 so that the outer edge of the pivoted-in travelling device 3 ends approximately flush with the side of the road milling machine 1. In this way, on the side on which one of the rear travelling devices 3 is pivoted, the milling drum may be arranged in such a fashion that the same extends up to the side of the machine frame 6 and ends preferably flush with the side of the road milling machine 1, and milling close to the edge is thus possible. The side on which close-to-the-edge milling is possible is called zero side.

The extraction device 12 is already depicted in FIG. 1. No transport device is provided in the embodiment shown. The milling drum 11 is arranged in a housing 10, in particular, a milling drum casing. An opening 15 is provided on the rear side 14 as seen in the direction of travel. The inlet opening 30 (FIG. 3) of the suction channel 18 (FIG. 3) is arranged behind the opening 15.

Figure 2:
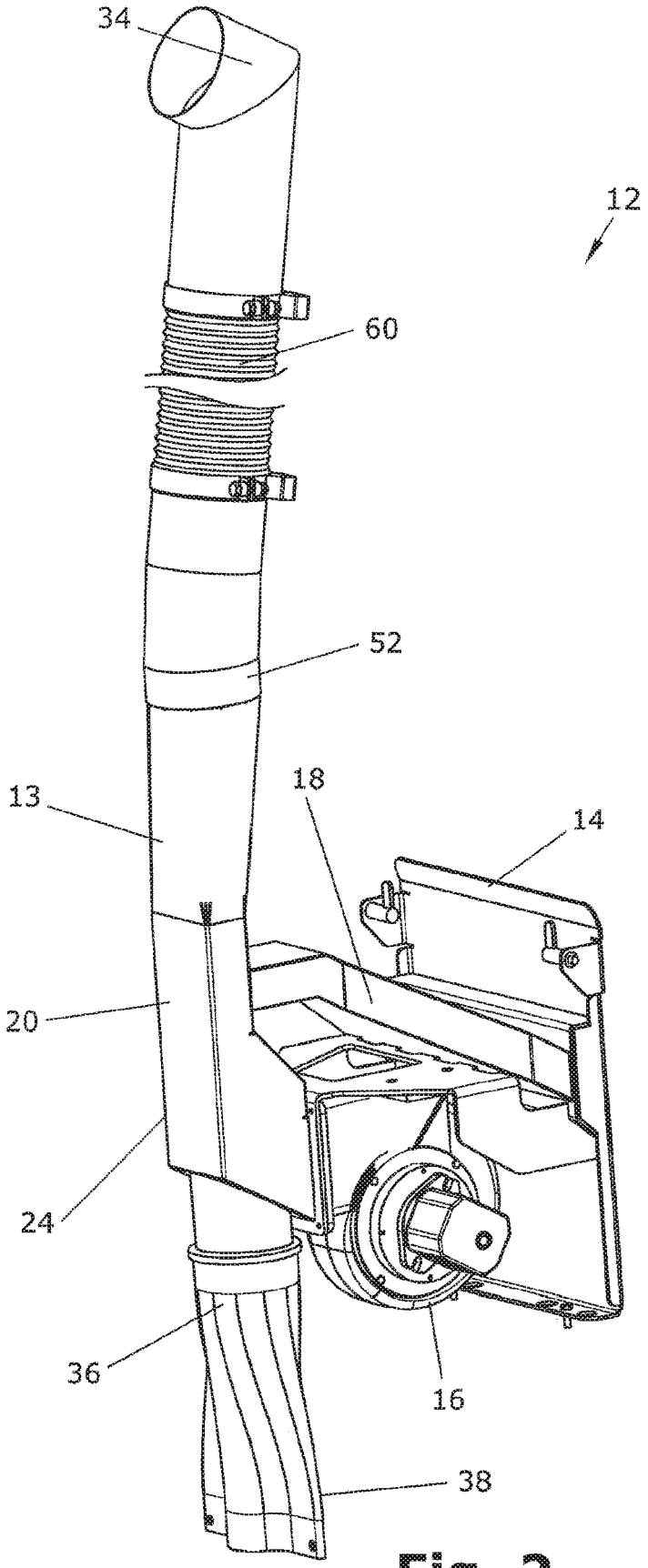
FIG. 2 an extraction device.
Figure 3:
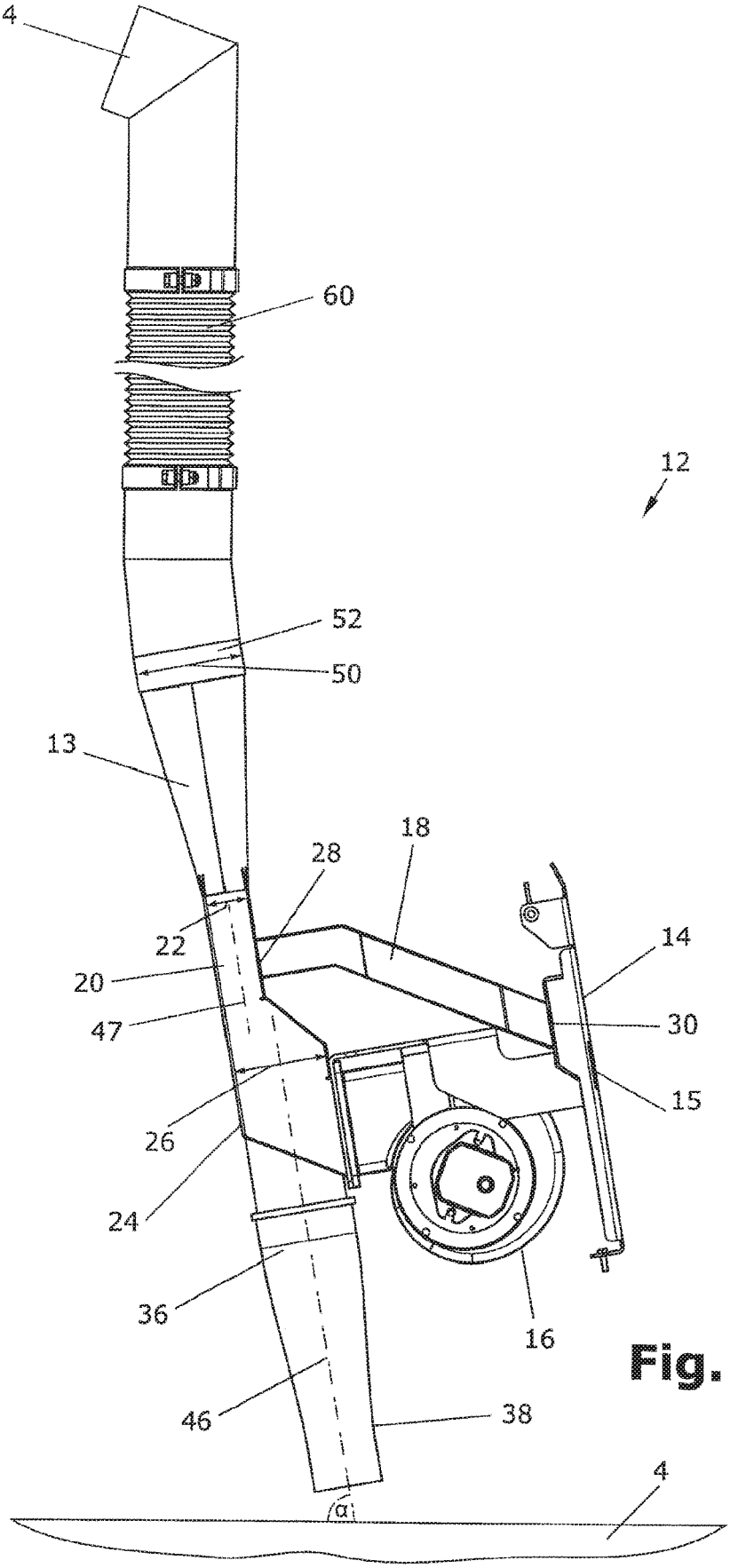
FIG. 3 the extraction device according to FIG. 2 in side view.
Figure 4:
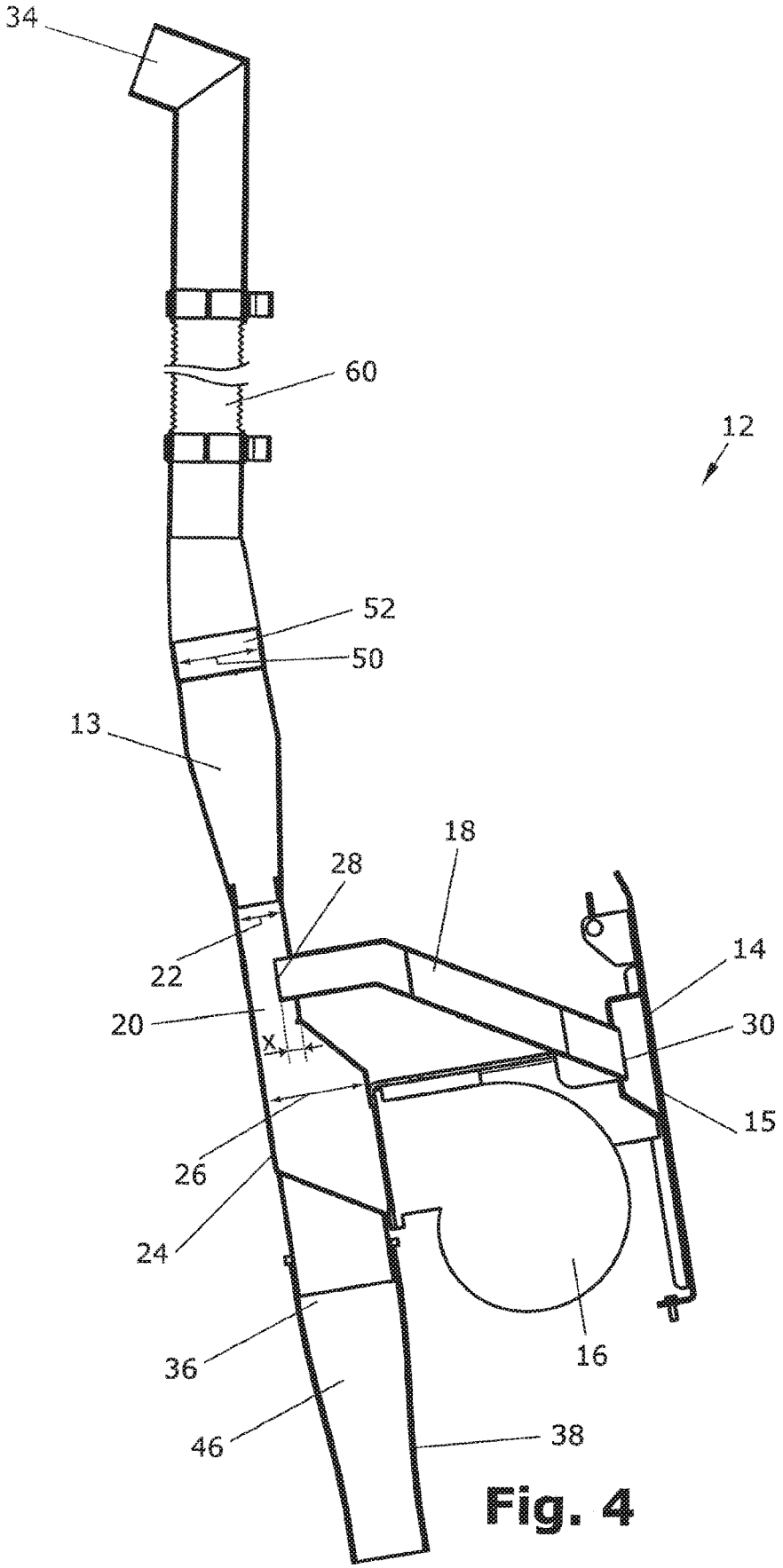
FIG. 4 the extraction device according to FIG. 3 in a sectional view.

The extraction device 12 is depicted in more detail in FIGS. 2, 3 and 4. The extraction device 12 comprises at least one exhaust air pipe 13. The first exhaust air pipe 13 comprises at least one first pipe section 24 and at least one second pipe section 20. The first pipe section 24 comprises at least one first cross-section 26, and the second pipe section 20 comprises at least one second cross-section 22. The second cross-section 22 is smaller than the first cross section 26. The suction channel 18 comprises an inlet opening 30 and an outlet opening 28. The outlet opening 28 opens into the second pipe section 20 of the extraction pipe 13.

A fan 16 is arranged below the suction channel 18. Said fan 16 is preferably arranged laterally next to the exhaust air pipe 13. Below and above is to be used in the following so as to be understood in relation to the ground pavement. Above means further away from the ground pavement, and below means closer to the ground pavement. The exhaust air pipe shown comprises at least a first longitudinal axis 46 in the first pipe section 24, and a second longitudinal axis 47 in the second pipe section 20. The first and the second longitudinal axis 46, 47 extend essentially perpendicular to the ground pavement. The first and/or the second longitudinal axis 46, 47 preferably exhibit an angle $\alpha$ of between 70° and 90° to the ground pavement 4.

The exhaust air pipe 13 may comprise a fourth pipe section 60 which is arranged above the first and second pipe section 24, 20, wherein the fourth pipe section 60 is designed as a flexible hose which is stretchable in its length. The flexible hose is designed in the form of a concertina and may therefore stretch in its length.

This has the advantage that the exhaust air pipe 13 may be fastened to the height-adjustable roof 62 of the road milling machine 1, wherein the roof 62 is a roof of the operator's platform 8.

As can be inferred from FIG. 4, the extraction channel 18 preferably projects into the exhaust air pipe 13 by the amount of X. In this way, the flow velocity in the exhaust air pipe in the area of the outlet opening 28 of the extraction channel 18 is particularly high, and the contaminated air can be carried off particularly well.

The exhaust air pipe 13 may be of single-piece or multiple-piece design. In the present case, the exhaust air pipe 13 is composed of multiple pieces. The exhaust air pipe does also not have to extend rectilinearly. The exhaust air pipe comprises a first and a second opening, wherein the second opening 34 is arranged above the first opening 36. The first opening 36 is arranged on the side facing the ground pavement. The contaminated air may exit the second opening 34.

A collection container 38 may be provided, as shown, on the first opening 36 of the exhaust air pipe 13. In the embodiment shown, the collection container 38 is open at the bottom. The same may, however, be easily closed with a lid. The collection container 38 may alternatively also be of a flexible material and be turned up at the lower end and be closed in this way.

The exhaust air pipe 13 may also comprise a third pipe section 52 which comprises a third cross-section, wherein the third cross-section 50 is larger than the second cross-section 22 of the second pipe section 20. The cross-section of the exhaust air pipe thus increases again behind the entry of the contaminated air as seen in the direction of flow. This has a particularly positive effect on the extraction of the contaminated air.

When dust develops in the milling drum casing, said dust may enter the extraction channel 18 through the opening 15 and the inlet opening 30. The fan 16 blows air into the exhaust air pipe 13. As a result of the air being blown into the first pipe section 24, and the second pipe section 20 exhibiting a smaller cross-section 22, the flow velocity is higher in the second pipe section 20. In this way, a negative pressure is created at the outlet opening 28 of the suction channel 18. The contaminated air is therefore sucked in by the suction channel 18.

The air blown into the exhaust air pipe 13 by the fan 16 therefore carries the contaminated air with it and conducts the same to the second opening 34 where the contaminated air may exit. If more coarse-grained dirt is present in the contaminated air which cannot be carried along by the air, the same falls downwards through the exhaust pipe 13 into the collection container 38. Since the fan 16 is arranged next to the exhaust air pipe, that is, next to the exhaust air pipe and below the extraction channel 18 in relation to the longitudinal axis 46, even the coarse-grained dirt does not fall onto the fan 16. The contaminated air 18 does also not have to flow through the fan 16. The fan is therefore arranged on the clean side. In this way, the fan 16 has a longer lifespan and requires less frequent cleaning.

The design of the extraction device enables the "Venturi effect" to be particularly well utilized, and the extraction process is particularly effective.

In a road milling machine 1, comprising a machine frame 6, at least three travelling devices 2, 3, wherein at least two travelling devices 3 are drivable and at least one travelling device 2 is steerable, at least one milling drum 11 for working the ground pavement 4, at least one extraction device 12 for extracting air contaminated with dusts and vapours, it is provided for the following features to be achieved: the extraction device 12 comprises at least one first exhaust air pipe 13 with at least one first pipe section 24 with at least one first cross-section 26 and at least one second pipe section 20 with at least one second cross-section 22, wherein the second cross-section 22 is smaller than the first cross-section 26, wherein a suction channel 18 comprises an inlet opening 30 and an outlet opening, wherein the outlet opening 28 opens into the exhaust air pipe 13 in the area of the second pipe section 20, wherein the air contaminated with dusts and vapours can be sucked in at the inlet opening 30.

What is claimed is:

1. A road milling machine, comprising:

a machine frame;

at least three travelling devices, wherein at least two of the travelling devices are drivable and at least one of the travelling devices is steerable;

at least one milling drum for working a ground pavement; and at least one extraction device configured to extract contaminated air, the extraction device including:

at least one exhaust air pipe including at least one first pipe section and at least one second pipe section, the at least one first pipe section having at least one first cross-section, and the at least one second pipe section having at least one second cross-section, the second cross-section being smaller than the first cross-section;

a fan connected to the first pipe section so that air can be blown into the exhaust air pipe by the fan, the second pipe section being downstream of the first pipe section such that the air flows first through the first pipe section and then through the second pipe section; and a suction channel including an inlet opening and an outlet opening, wherein the outlet opening opens into the second pipe section of the exhaust air pipe, so that contaminated air can be sucked in at the inlet opening.

2. The road milling machine of claim 1, wherein:

the exhaust air pipe further includes a flexible hose arranged above the first and second pipe sections, the flexible hose being stretchable in length.

3. The road milling machine of claim 1, wherein:

the first pipe section extends along a first longitudinal axis oriented at an angle to the ground pavement in a range from 70° to 90°.

4. The road milling machine of claim 3, wherein:

the fan is configured such that air from the fan enters the air exhaust pipe at an angle in a range from 60° to 90° to the first longitudinal axis.

5. The road milling machine of claim 3, wherein:

the suction channel enters the air exhaust pipe at an angle in a range from 60° to 90° to the first longitudinal axis.

6. The road milling machine of claim 1, wherein:

the suction channel projects into the air exhaust pipe.

7. The road milling machine of claim 1, wherein:

the air exhaust pipe includes a first opening and a second opening, the second opening being arranged above the first opening, and the contaminated air may exit the second opening.

8. The road milling machine of claim 7, wherein:

the first opening of the exhaust air pipe faces the ground pavement.

9. The road milling machine of claim 8, wherein:

the extraction device further includes a collection container arranged at the first opening of the exhaust air pipe.

10. The road milling machine of claim 1, wherein:

the air exhaust pipe includes a first opening and a second opening, the second opening being arranged above the first opening, and the contaminated air may exit the second opening;

further comprising:

an operator's platform, wherein the second opening of the exhaust air pipe is arranged above the operator's platform.

11. The road milling machine of claim 1, wherein:

the exhaust air pipe further includes a third pipe section arranged behind the second pipe section as seen in a direction of flow, wherein the third pipe section has a third cross-section larger than the second cross-section of the second pipe section.

12. The road milling machine of claim 1, further comprising:

a milling drum casing arranged around the milling drum, the milling drum casing including a rear side as seen in a direction of travel, the rear side including an opening connected to the suction channel to form the inlet opening of the suction channel.

13. The road milling machine of claim 1, wherein:

the at least three travelling devices includes at least two rear traveling devices, and the milling drum is arranged between the two rear travelling devices.

14. A road milling machine, comprising:

a machine frame;

at least three travelling devices, wherein at least two of the travelling devices are drivable and at least one of the travelling devices is steerable;

at least one milling drum for working a ground pavement; and at least one extraction device configured to extract contaminated air, the extraction device including:

at least one exhaust air pipe including at least one first pipe section and at least one second pipe section, the at least one first pipe section having at least one first cross-section, and the at least one second pipe section having at least one second cross-section, the second cross-section being smaller than the first cross-section; and a suction channel including an inlet opening and an outlet opening, wherein the outlet opening opens into the second pipe section of the exhaust air pipe, so that contaminated air can be sucked in at the inlet opening;

wherein the first pipe section extends along a first longitudinal axis oriented at an angle to the ground pavement in a range from 70° to 90°; and wherein the extraction device further includes a fan connected to the first pipe section so that air can be blown into the exhaust air pipe by the fan, the fan being arranged below the suction channel and, relative to the first longitudinal axis of the exhaust air pipe, laterally next to the exhaust air pipe.

15. A road milling machine, comprising:

a machine frame;

at least three travelling devices, wherein at least two of the travelling devices are drivable and at least one of the travelling devices is steerable;

at least one milling drum for working a ground pavement; and at least one extraction device configured to extract contaminated air, the extraction device including:

at least one exhaust air pipe including at least one first pipe section and at least one second pipe section, the at least one first pipe section having at least one first cross-section, and the at least one second pipe section having at least one second cross-section, the second cross-section being smaller than the first cross-section; and a suction channel including an inlet opening and an outlet opening, wherein the outlet opening opens into the second pipe section of the exhaust air pipe, so that contaminated air can be sucked in at the inlet opening;

wherein the extraction device is demountable from the road milling machine; and wherein the road milling machine further includes fasteners configured such that a transport conveyor may be connected to the road milling machine in lieu of the extraction device.

* * * * *